US006415754B1

(12) United States Patent
Hirano et al.

(10) Patent No.: US 6,415,754 B1
(45) Date of Patent: Jul. 9, 2002

(54) ROCKER ARM SUPPORT MECHANISM

(75) Inventors: Michio Hirano, Akashi; Tetsuaki Shirai, Kobe, both of (JP)

(73) Assignee: Kawasaki Jukogyo Kabushiki Kaisha, Hyogo-ken (JP)

( * ) Notice: Subject to any disclaimer, the term of this patent is extended or adjusted under 35 U.S.C. 154(b) by 0 days.

(21) Appl. No.: 09/954,047

(22) Filed: Sep. 18, 2001

(30) Foreign Application Priority Data

Sep. 21, 2000 (JP) ..... 2000-286929

(51) Int. Cl.[7] ..... F01L 1/18; F01L 1/20
(52) U.S. Cl. ..... 123/90.43; 123/90.45
(58) Field of Search ..... 123/90.39, 90.41, 123/90.43, 90.45; 74/519, 559

(56) References Cited

U.S. PATENT DOCUMENTS 1,948,063 A * 2/1934 Burkhardt ..... 123/90.45
4,643,141 A * 2/1987 Bledsoe ..... 123/90.16

FOREIGN PATENT DOCUMENTS

JP U 61-145804 9/1986

* cited by examiner

*Primary Examiner*—Weilun Lo
(74) *Attorney, Agent, or Firm*—Oliff & Berridge, PLC

(57) ABSTRACT

A rocker arm support mechanism includes a holding member (3), a rocker arm shaft (6) and a nut (31). The holding member (3) has a base wall fastened to an end surface of a cylinder head, and a pair of support walls (3*a*) each provided with a hole (28). The rocker arm shaft (6) includes an eccentric sleeve (15) having a bore (20) and a circumference (15*a*) eccentric to the bore (20), and a support shaft (14) passed through the hole (28) of one of the side walls (3*a*), the bore (20) of the eccentric sleeve (15) and the hole (28) of the other side wall (3*a*). The support shaft (14) is inserted in the bore (20) of the eccentric sleeve (15) and the eccentric sleeve (15) is restrained from turning relative to the support shaft (14). A rocker arm (5) is put on the eccentric sleeve (15) for turning on the eccentric sleeve (15), the eccentric sleeve (15) is turned about the axis of the support shaft (14) relative to the holding member (3) to adjust the height of the rocker arm (5) from the end surface of the cylinder head. The rocker arm (5) and the holder (3) are formed by plate work. The support shaft (14) and the eccentric sleeve (15) are manufactured separately. The support shaft (14) has a head (14*a*) and a threaded part (14*b*). The nut (31) is screwed on the threaded part (14*b*) of the support shaft (14) to fasten the rocker arm shaft (6) to the support walls (3*a*).

3 Claims, 6 Drawing Sheets

ROCKER ARM SUPPORT MECHANISM

BACKGROUND OF THE INVENTION

1. Field of the Invention

The present invention relates to a rocker arm support mechanism for an internal-combustion engine.

2. Description of the Related Art

Rocker arms are classified into those formed by forging and those formed by platework. FIGS. 8 and 9 show a forged rocker arm 100. As shown in FIG. 9, the rocker arm 100 has a boss 101 formed integrally with its middle part. The rocker arm 100 is mounted for a rocking motion on a rocker-arm shaft 103 fixedly held on a holder 102 with the rocker-arm shaft 103 fitted in a bore formed in the boss 101. The rocker arm 100 has one end provided with a valve clearance adjusting mechanism including an adjusting screw 105 and a nut 106 and the other end provided with a recess 109 as shown in FIG. 8. The lower end of the adjusting screw 105 is in contact with the end of a valve stem 108 and the upperend of a push rod 110 is received in the recess 109 as shown in FIG. 8.

FIGS. 10 and 11 show a plate rocker arm 119 formed by plate work. As shown in FIG. 11, the rocker arm 119 has an upward concave spherical part 121 provided with a slot 120 in its middle part. A support bolt 123 set upright on a cylinder head penetrates the spherical part 121. A holding member 125 having a spherical end part 125*a* is put on the support bolt 123 so that the spherical end part 125*a* is received in a spherical recess defined by the spherical part 121. A nut 126 is screwed on the support bolt 123 to hold the holding member 125 in place. The rocker arm 119 has one end provided with a spherical protrusion 128 protruding downward so as to be inn contact with the end of a valve stem 127 and the other end provided with a spherical protrusion 132 protruding upward as shown in FIG. 10 and the head of a push rod is received in the spherical protrusion 132. Valve clearance is adjusted by turning the nut 126. The rocker arm formed by plate work is disclosed in JP-U No. Sho 61-145804.

The forged rocker arm 100 shown in FIGS. 8 and 9 is costly and needs the adjusting screw 105 and the nut 106 additionally for valve clearance adjustment, which increases the cost and weight of the rocker arm.

The machining accuracy of press working for forming the spherical part 121 of the plate rocker arm 119 shown in FIGS. 10 and 11 is not very high and the spherical part 121 is subject to deformation. Therefore it is possible that the accuracy of engagement of the spherical part 121 and the spherical end 125*a* of the holding member 125 is unsatisfactory. The rocker arm 119 is apt to shake in the directions of the arrows shown in FIG. 10. Consequently, the adjustment of valve clearance is liable to take much time and to be unsatisfactory. Since the rocker arm 119 shakes, the operation of the rocker arm 119 is liable to be unstable. When the push rod 131 moves along an oblique line, the shaky motion of the rocker arm 119 varies valve clearance greatly. Usually, the push rod 131 is guided by a guide plate 140 provided with a guide hole 141 as shown in FIG. 10 to suppress shaking.

SUMMARY OF THE INVENTION

Accordingly, it is an object of the present invention to provide a low-cost rocker arm support mechanism capable of suppressing the shaking of a rocker arm, of facility valve clearance adjustment and of ensuring correct valve clearance adjustment.

According to the present invention, a rocker arm support mechanism comprises: a holding member having a base wall fastened to an end surface of a cylinder head, and a pair of support walls each provided with a hole; a rocker arm shaft including an eccentric sleeve having a bore and a circumference eccentric to the bore and disposed between the support walls of the holding member, and a support shaft passed through the hole of one of the side walls of the holding member, the bore of the eccentric sleeve and the hole of the otherside wall of the holding member, wherein a rocker arm is put on the eccentric sleeve for turning on the eccentric sleeve, the eccentric sleeve is turned about the axis of the support shaft relative to the holding member to adjust the height of the rocker arm from the end surface of the cylinder head.

The rocker arm support mechanism does not need an adjusting screw an a nut specially for valve clearance adjustment. The valve clearance can be easily adjusted simply by turning the eccentric sleeve on the support shaft. The rocker arm support mechanism is capable of supporting the rocker arm so that the rocker arm may not shake.

In the rocker arm support mechanism according to the present invention, it is preferable that the rocker arm and the holding member are formed by plate work, the support shaft and the eccentric sleeve are manufactured separately, the support shaft has a head in one end part thereof and a threaded part in the other end part thereof, the eccentric sleeve has a cylindrical shape, the eccentric sleeve is restrained from turning relative to the support shaft, and a nut is screwed on the threaded part of the support shaft to clamp the eccentric sleeve firmly between the support walls of the holding member. Thus valve clearance can be accurately and easily adjusted even through the inexpensive rocker arm formed by plate work is employed.

In the rocker arm support mechanism according to the present invention, it is preferable that the rocker arm and the holding member are formed by plate work, the support shaft and the eccentric sleeve are manufactured separately, the support shaft has a head in one end part thereof and a threaded part in the other end part thereof, the eccentric sleeve has a cylindrical shape, the eccentric sleeve is mounted on a part between the support walls of the holding member of the support shaft for turning relative to the support shaft, and a nut is screwed on the threaded part of the support shaft to clamp the eccentric sleeve firmly between the support walls of the holding member. Thus valve clearance can be accurately and easily adjusting even through the inexpensive rocker arm formed by plate work is employed.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 5:
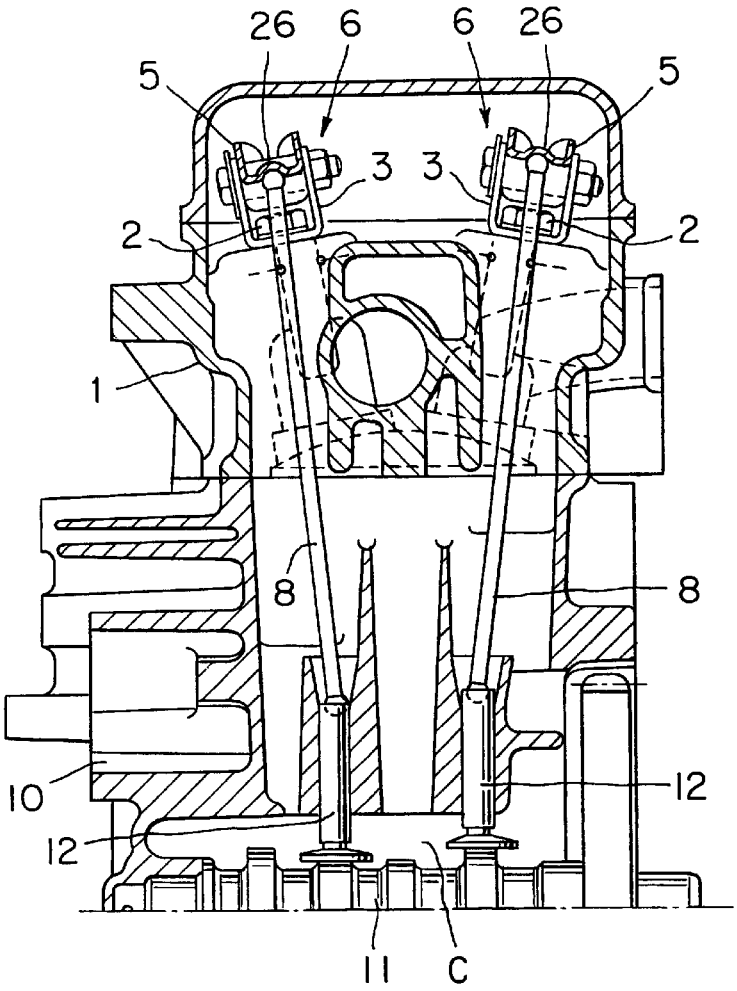
FIG. 5 is a fragmentary, longitudinal sectional view of an internal-combustion engine provided with rocker arms similar to that shown in FIG. 1.

FIG. 5 shows an internal-combustion engine employing rocker arm support mechanisms in a preferred embodiment according to the present invention in a longitudinal sectional view. Each of the rocker arm support mechanisms include a holding member 3 formed by plate work and a rocker arm shaft 6. Rocker arms 5 respectively for an inlet valve and an exhaust valve are supported for rocking on the holding members 3 by the rocker arm shafts 6, respectively. Push rods 8 are extended obliquely so that the interval between the push rods 8 increases upward. The upper ends of the push rods 8 are in contact with upward convex spherical parts 26 formed in end parts of the rocker arms 5, respectively. The lower ends of the push rods 8 are in contact with the upper ends of valve tappets 12 engaged with a camshaft 11 supported on a cylinder block 10.

Figure 3:
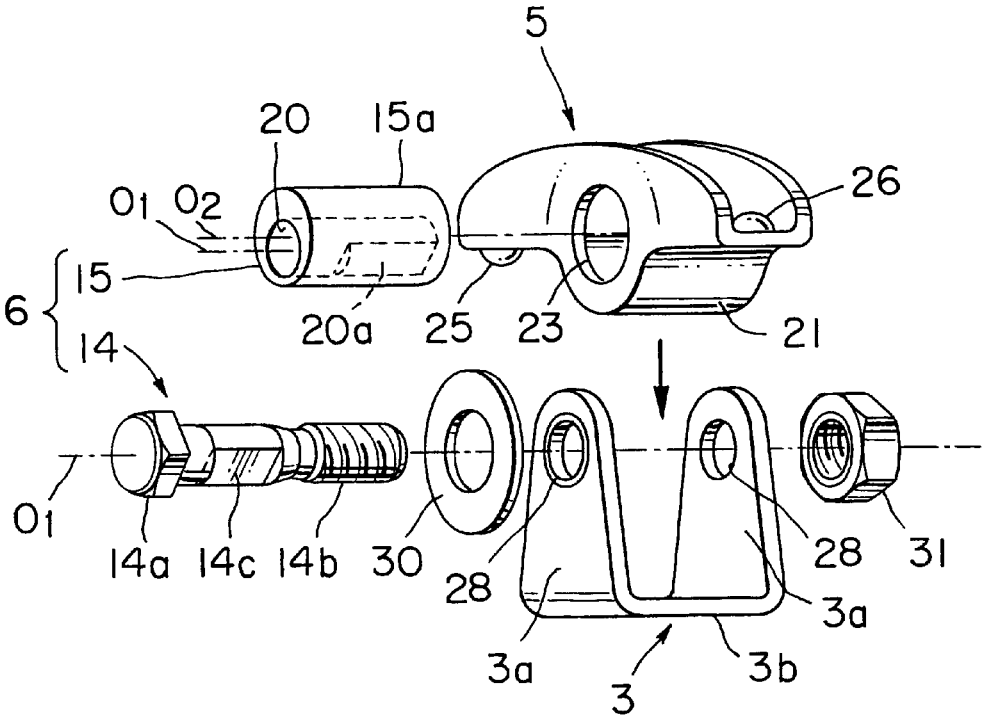
FIG. 3 is an exploded perspective view of the rocker arm support structure shown in FIG. 1.

Referring to FIG. 3, the holding member 3 is formed by bending a plate and has a base part 3*b* and a pair of parallel support walls 3*a*. The support walls 3*a* are provided with holes 28 having one and the same center axis $O_1$, which also is the center axis of the support shaft 14. The rocker arm shaft 6 is a composite shaft including a support shaft 14 formed by forging and having parts fitting the holes 28 of the support walls 3*a*, and an eccentric sleeve 15 formed by sintering. The support shaft 14 and the eccentric sleeve 15 are separate members. The support shaft 14 is provided with a hexagon head 14*a* in one end part thereof and a threaded part 14*b* in the other end part thereof. A flat 14*c* is formed in a middle part of the support shaft 14. The eccentric sleeve 15 has a bore 20 in which the support shaft 14 is fitted. The bore is provided with a flat 20*a* that engages the flat 14*c* of the support shaft 14 to restrain the eccentric sleeve 15 from turning relative to the support shaft 14. The eccentric sleeve 15 has a cylindrical circumference 15*a* having a center axis $O_2$. The center axis $O_2$ deviates by a predetermined distance from the center axis $O_1$ of the holes 28 of the support walls 3*a*, which also is the center axes of the support shaft 14 and the bore 20 of the eccentric sleeve 15. The height of the cylindrical circumference 15*a* from the center axis $O_1$ can be varied by turning the rocker room shaft 6 about the center axis $O_1$ of the support shaft 14. The eccentric sleeve 15 has a length substantially equal to the distance between the inner surfaces of the support walls 3*a*.

The rocker arm 5 has a U-shaped cross section. A middle part of the rocker arm 5 is protruded to form a boss 21 of a semicylindrical shape. A bore 23 is formed in the boss 21 in a diameter substantially equal to the outside diameter of the cylindrical circumference 15*a* of the eccentric sleeve 15. The eccentric sleeve 15 is fitted in the bore 23 of the rocker arm 5. The upward convex spherical part 26 that engages the push rod 8 is formed in one end part of the rocker arm 5. A valve operating downward convex spherical part 25 that engages the valve stem end of a valve is formed in the other end part of the rocker arm 5. The axial length of the boss 21 of the rocker arm 5 is slightly smaller than the length of the eccentric sleeve 15.

The eccentric sleeve 15 is fitted in the above 23 of the rocker arm 5 so as to be turnable about the center axis $O_2$ relative to the eccentric sleeve 15 and the rocker arm 5 is placed between the support walls 3*a* of the holding member 3. The support shaft 14 is passed through a washer 30, the hole 28 of one of the support walls 3*a*, the bore 20 of the eccentric sleeve 15 and the hole 28 of the other support wall 3*a* so that the flat 14*c* engages the flat 20*a*, and the nut 31 is screwed on the threaded part 14*b* of the support shaft 14.

Figure 1:
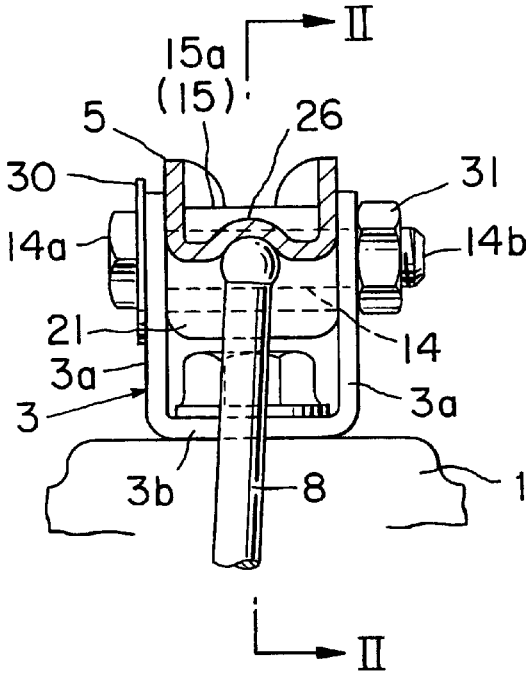
FIG. 1 is a sectional view of a rocker arm support mechanism in a preferred embodiment according to the present invention.
Figure 4:
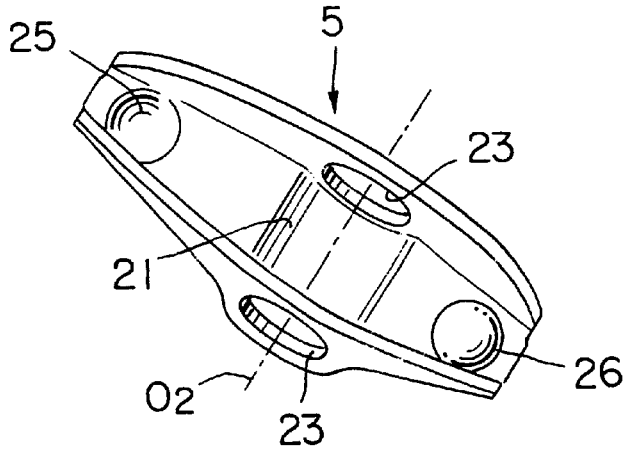
FIG. 4 is a plan view of a rocker arm.

As shown in FIG. 1, the support walls 3*a* are clamped between the head 14*a* of the support shaft 14 and the nut 31 screwed on the threaded part 14*b* of the support shaft 14 to hold the support shaft 14 and the eccentric sleeve 15 fixedly on the holding member 3. Since the axial length of the boss 21 of the rocker arm 5 is slightly smaller than the length of the eccentric sleeve 15, the rocker arm 5 is able to turn on the eccentric sleeve 15. As shown in FIG. 4, the rocker arm 5 is tapered from the boss 21 toward the opposite end thereof.

The rocker arm 5 and the rocker arm support mechanism are assembled and the valve clearance is adjusted in the following manner.

Referring to FIG. 3, the eccentric sleeve 15 having the cylindrical circumference 15*a* is fitted in the bore 23 of the rocker arm 5 and the rocker arm 5 is placed between the support walls 3*a* of the holding member 3. Then, the support shaft 14 is passed through the washer 30, the hole 28 of one of the support walls 3*a*, the bore 20 of the eccentric sleeve 15 and the hole 28 of the other support wall 3*a*, and the nut 31 is screwed loosely on the threaded part 14*b* of the support shaft 14 to fasten the support shaft 14 temporarily to the holding member 3.

Figure 2:
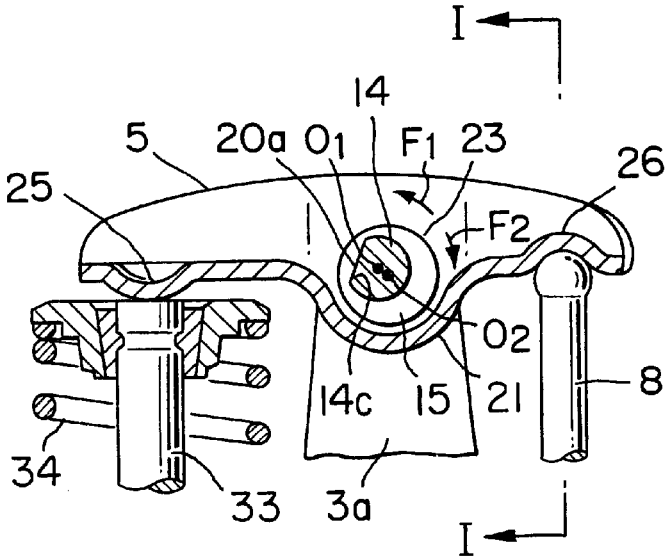
FIG. 2 is a sectional view taken on line II—II in FIG. 1.

Referring to FIG. 2, the support shaft 14 is turned about the center axis $O_1$ to adjust the height of the eccentric sleeve 15 from the upper end of the cylinder head. Thus, the clearance between the downward convex spherical part 25 of the rocker arm 5 and a valve stem 33 is adjusted. For example, the rocker arm 5 is elevated if the support shaft 14 is turned counterclockwise in the direction of the arrow F1 in FIG. 2, or the rocker arm 5 is lowered if the support shaft 14 is turned clockwise in the direction of the arrow F2 in FIG. 2.

After the valve clearance has been properly adjusted, the nut 31 is fastened tight to clamp the support walls 3*a* firmly between the head 14*a* and the nut 31. Thus, the eccentric sleeve 15 is held firmly between the support walls 3*a* to hold the rocker arm shaft 6 fixedly on the holding member 3.

The push rod 8 engaging the upward convex spherical part 26 of the rocker arm 5 pushes up the end part provided with the upward convex spherical part 26 of the rocker arm 5 to depress the valve stem 3 against the resilience of a valve spring 34 by the downward convex spherical part 25 to open the inlet valve or the exhaust valve. Since the rocker arm 5 is supported on the rocker arm shaft 6 by fitting the cylindrical eccentric sleeve 15 of the rocker arm shaft 6 in the bore 23 of the boss 21 of the rocker arm 5 instead of supporting the same on a spherical support member, the shaking movement of the rocker arm 5 formed by plate work can be suppressed during a valve operating operation.

Figure 6:
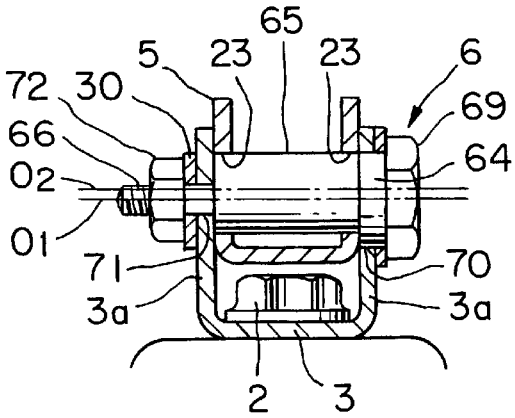
FIG. 6 is a sectional view of rocker arm support mechanism in a first modification of the rocker arm support mechanism shown in FIG. 1.

FIG. 6 shows a rocker arm shaft 6 in a modification of the rocker shaft arm 6 of the rocker arm support mechanism in the preferred embodiment. The rocker arm shaft 6 shown in FIG. 6 has a support part 64 and an eccentric part 65 formed integrally with the support part 64. The eccentric part 65 to be fitted in the bore 23 of the rocker arm 5 is solid. A threaded part 66 of a small diameter projects from one end of the eccentric part 64, and the support part 64 is formed on the other end of the eccentric part 65 in a diameter greater than that of the eccentric part 64. The support part 64 is provided with a hexagon head 69. The support part 64 and the threaded part 66 have one and the same center axis $O_1$. The eccentric part 65 has a center axis $O_2$ deviated by a predetermined distance from the center axis $O_1$ of the support part 64 and the threaded part 66. A holding member 3 has a pair of parallel support walls 3*a*. One of the support wall 3*a* is provided with a hole 70 in which the support part 64 is fitted and the other support wall 3*a* is provided with a hole 71 in which the threaded part 66 is fitted. The holes 70 and 71, the support part 64 and the threaded part 66 are coaxial. The support part 64 and the threaded part 66 are inserted in the holes 70 and 71, respectively, and a nut 72 is screwed on the threaded part 66 to fasten the rocker arm shaft 6 firmly to the holding member 3.

When supporting the rocker arm 5 shown in FIG. 6 by the rocker arm support mechanism, the rocker arm 5 is placed between the support walls 3*a,* the rocker arm shaft 6 is passed through the side walls 3*a* and the rocker arm 5 so that the support part 64 is fitted in the hole 70 of a larger diameter, the eccentric part 65 is fitted in the bore 23 of the rocker arm 5, and the threaded part 66 is extended through the hole 71 of the support wall 3*a.* Then the nut 72 is screwed loosely on the threaded part 66 to fasten the rocker arm shaft 6 temporarily to the holding member 3. In this state, the rocker arm shaft 6 is turned about the center axis $O_1$ to elevate or lower the rocker arm 5 to adjust the valve clearance. After the valve clearance has been properly adjusted, the nut 72 is fastened tight to fasten the rocker arm shaft 6 firmly to the holding member 3.

Figure 7:
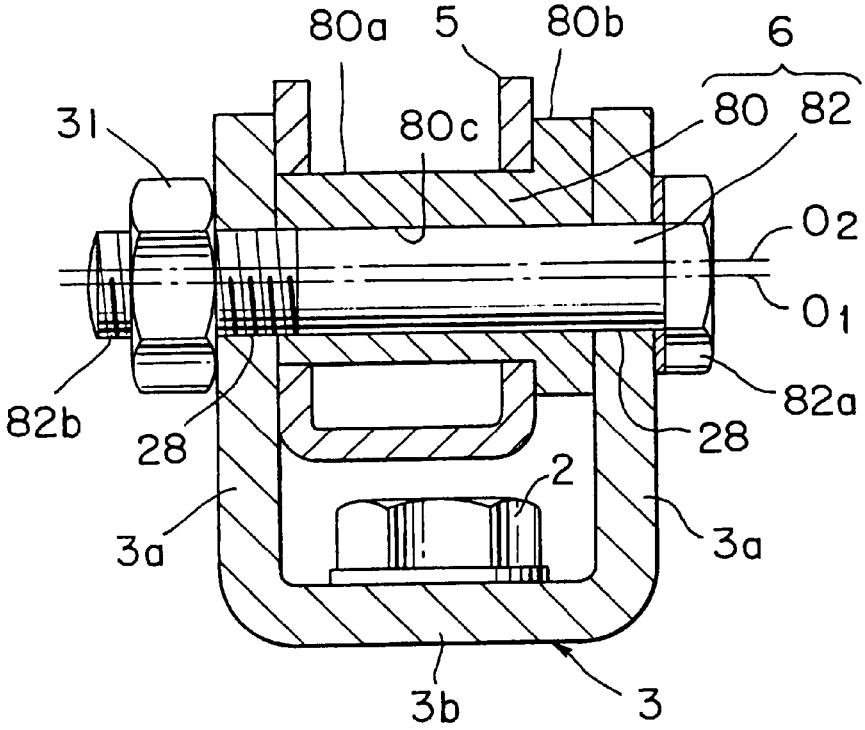
FIG. 7 is a sectional view of rocker arm support mechanism in a second modification of the rocker arm support mechanism shown in FIG. 1.
Figure 8:
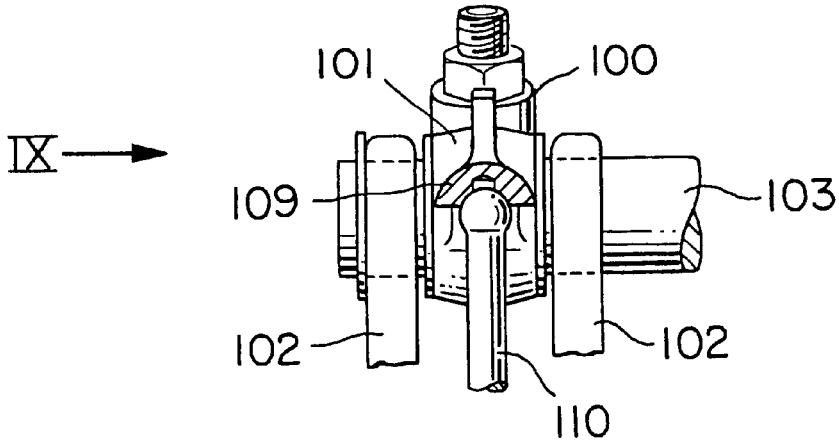
FIG. 8 PRIOR ART
FIG. 8 is a longitudinal sectional view of a conventional rocker arm support structure for supporting a rocker arm formed by forging.
Figure 9:
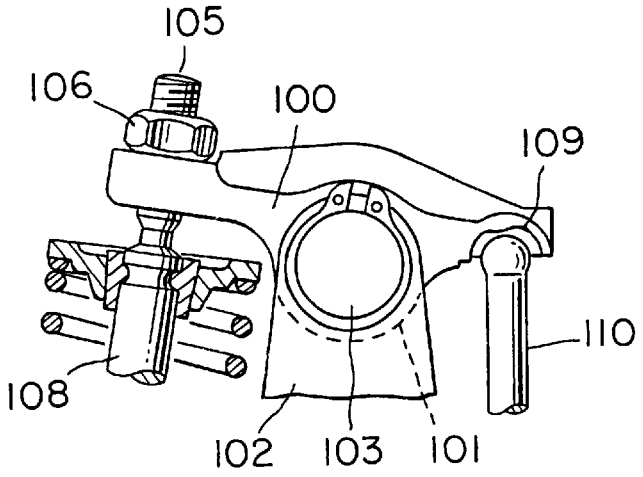
FIG. 9 PRIOR ART
FIG. 9 is a side elevation taken in the direction of the arrow IX in FIG. 8.
Figure 10:
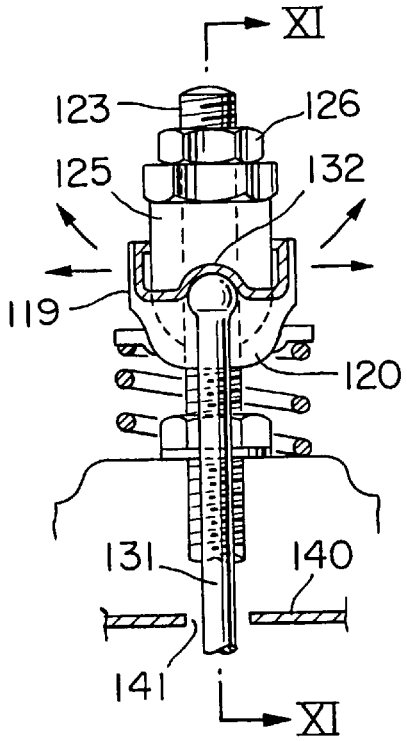
FIG. 10 PRIOR ART
FIG. 10 is a longitudinal sectional view of a prior art rocker arm support mechanism for supporting a rocker arm formed by plate work.

FIG. 7 shows a rocker arm shaft 6 in a second modification of the rocker arm shaft 6 included in the rocker arm support mechanism in the preferred embodiment. As shown in FIG. 7, a holding member 3 has a pair of parallel support walls 3*a* provided with holes 28, respectively. The rocker arm shaft 6 has a support shaft 83 formed by forging and a cylindrical eccentric sleeve 80 formed by sintering. The support shaft 82 is fitted in the holes 28 of the support walls 3*a*. The support shaft 82 is provided with a hexagon head 82*a* in one end part thereof and a threaded part 82*b* in the other end part thereof. The eccentric sleeve 80 has a bore 80*c* in which the support shaft 82 is fitted. The eccentric sleeve 80 has a cylindrical circumference 80*a* having a center axis $O_2$. The center axis $O_2$ deviates by a predetermined distance from the center axis $O_1$ of the bore 80*c* (the support shaft 82) of the eccentric sleeve 80. The height of the cylindrical circumference 80*a* from the center axis $O_1$ can be varied by turning the eccentric sleeve 80 about the center axis $O_1$ of the support shaft 82. A flange 80*b* of, for example, a hexagonal shape is formed on one end of the eccentric sleeve 80. A tool, such as a wrench, is engaged with the flange 80*b* to turn the eccentric sleeve 80. The rocker arm 5 is mounted on the cylindrical eccentric sleeve 80 so as to be turnable about the center axis $O_2$. A nut 31 is screwed on the threaded part 82*b* of the support shaft 82.

When supporting the rocker arm shown in FIG. 7 by the rocker arm support mechanism, the eccentric sleeve 80 is fitted in the rocker arm 5, the rocker arm 5 is placed between the support walls 3*a,* the support shaft 82 is passed through the hole 28 of one of the side walls 3*a,* the bore 80*c* of the eccentric sleeve 80 and the hole 28 of the other support wall 3*a,* and the nut 31 is screwed loosely on the threaded part 82*b* of the support shaft 82 to fasten the support shaft 82 temporarily to the holding member 3. A tool, such as a wrench is engaged with the flange 80*b* of the eccentric sleeve 80 and the eccentric sleeve 80 is turned on the support shaft 82 to adjust the height of the rocker arm 5. After the height of the rocker arm 5 has been properly adjusted, the nut 31 is fastened tight so that the support walls 3*a f* the holding member 3 are deformed elastically and the eccentric sleeve 80 is fastened firmly to the holding member 3.

The flange 80*b* of the eccentric sleeve 80 does not need necessarily to be hexagonal, but may be formed in any suitable shape, such as a square shape, or may be provided with holes into which a sleeve turning tool can be inserted. The nut 31 may be welded to the support wall 3*a.* if the nut 31 is welded to the support wall 3*a,* the support shaft 82 will not turn together with the eccentric sleeve 80 when the eccentric sleeve 80 is turned for valve clearance adjustment, which facilitates work for valve clearance adjustment. The rocker arm support mechanism of the present invention is applicable to supporting a forged rocker arm.

Thus the rocker arm support mechanism employing the rocker arm shaft having the support shaft and the eccentric sleeve enables the adjustment of the height of the rocker arm simply by turning the eccentric sleeve about the center axis of the support shaft and hence the adjustment of the valve clearance can be easily achieved. The rocker arm support mechanism does not need to adjusting screw and a nut specially for valve clearance adjustment, which reduces the part cost of the internal combustion engine.

Since the rocker arm is supported on the rocker arm shaft for rocking motion instead of supporting the same on a spherical support, the push rod does not need to be guided by a guide plate or the like and the shaking of the rocker arm can be prevented. The shaking preventing effect is particularly significant with a rocker arm operating mechanism provided with a push rod extended in an oblique position. The rocker arm support mechanism of the present invention is capable of properly supporting a rocker arm formed by plate work, which is far less expensive than a forged rocker arm.

Figure 11:
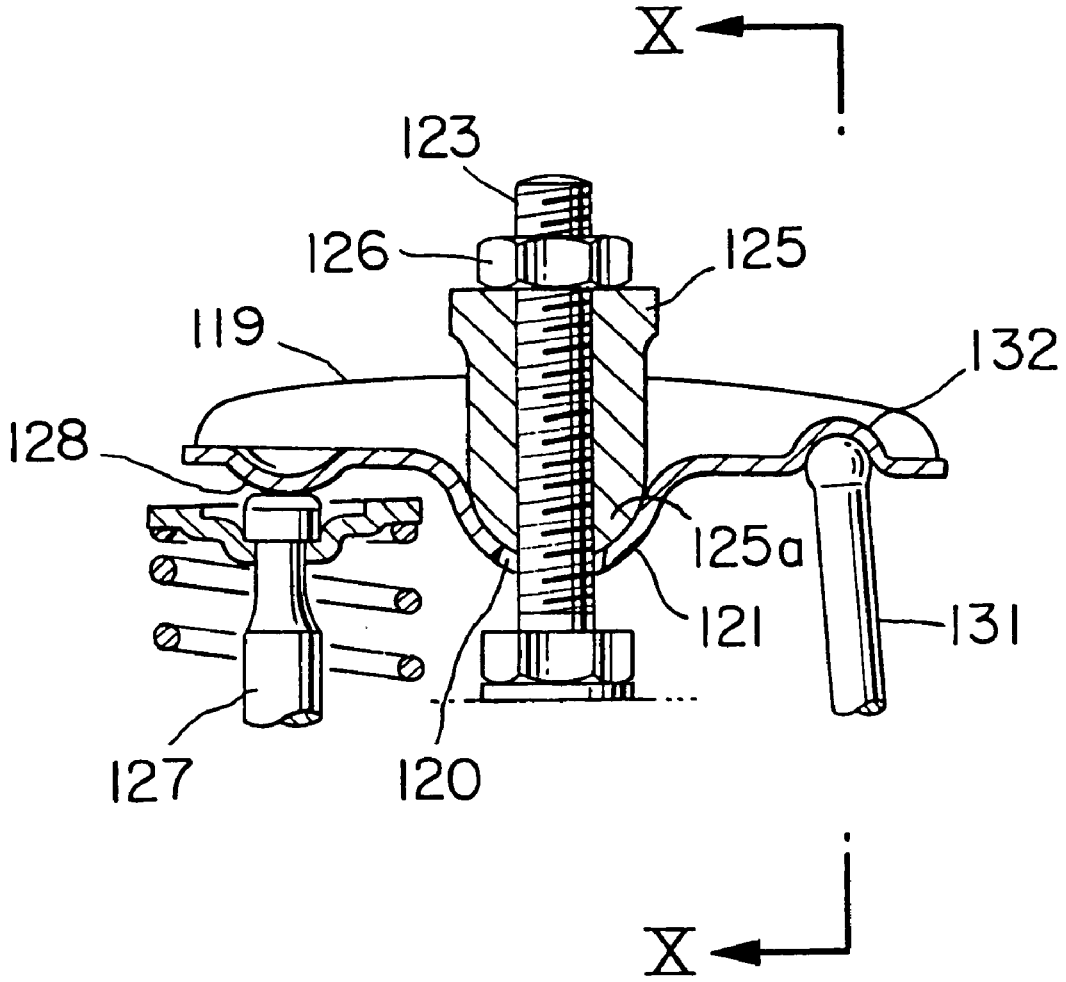
FIG. 11 PRIOR ART
FIG. 11 is a sectional view taken on line XI–IX in FIG. 10.

The rocker arm support mechanism including the support shaft and the eccentric sleeve and capable of properly supporting a rocker arm formed by plate work does not need any highly accurate machining that may be needed by the rocker arm support mechanism including the special holding member having a spherical bearing surface is shown in FIG. 11. Thus, the rocker arm support mechanism of the present invention comprises the components that can be easily manufactured and facilitate work for valve clearance adjustment.

Although the invention has been described in its preferred embodiments with a certain degree of particularly, obviously many changes and variations are possible therein. It is therefore to be understood that the present invention may be practiced otherwise than as specifically described herein without departing from the scope and spirit thereof.

What is claimed is:

1. A rocker arm support mechanism comprising:

a holder member having a base wall fastened to an end surface of a cylinder head, and a pair of support walls each provided with a hole;

a rocker arm shaft including an eccentric sleeve having a bore and a circumference eccentric to the bore and disposed between the support walls of the holding member, and a support shaft passed through the hole of one of the side walls of the holding member, the bore of the eccentric sleeve and the hole of the other side wall of the holding member;

wherein a rocker arm is put on the eccentric sleeve for turning on the eccentric sleeve, the eccentric sleeve is turned about the axis of the support shaft relative to the holding member to adjust the height of the rocker arm from the end surface of the cylinder head.

2. The rocker arm support mechanism according to claim 1, wherein the rocker arm and the holding member are formed by plate work, the support shaft and the eccentric sleeve are manufactured separately, the support shaft has a head in one end part thereof and a threaded part in the other end part thereof, the eccentric sleeve has a cylindrical shape, the eccentric sleeve is restrained from turning relative to the support shaft, and a nut is screwed on the threaded part of the support shaft to clamp the eccentric sleeve firmly between the support walls of the holding member.

3. The rocker arm support mechanism according to claim 1, wherein the rocker arm and the holding member are formed by plate work, the support shaft and the eccentric sleeve are manufactured separately, the support shaft has a head in one end part thereof and a threaded part in the other end part thereof, the eccentric sleeve has a cylindrical shape, the eccentric sleeve is mounted on a part between the support walls of the holding member of the support shaft for turning relative to the support shaft, and a nut is screwed on the threaded part of the support shaft to clamp the eccentric sleeve firmly between the support walls of the holding member.

* * * * *